United States Patent [19]
Atchisson
[11] 4,169,329
[45] Oct. 2, 1979

[54] WEAPON CONVERSION APPARATUS

[76] Inventor: Maxwell G. Atchisson, 55 Old Yellow Springs Rd., Fairborn, Ohio 45324

[21] Appl. No.: 830,607

[22] Filed: Sep. 6, 1977

[51] Int. Cl.[2] ..... F41C 11/00
[52] U.S. Cl. ..... 42/16; 42/49 A
[58] Field of Search ..... 42/16, 49 A

[56] References Cited

U.S. PATENT DOCUMENTS

| | | | |
|---|---|---|---|
| 3,771,415 | 11/1973 | Into et al. | 42/49 A |
| 3,776,095 | 12/1973 | Atchisson | 42/16 |
| 4,008,537 | 2/1977 | Elbe | 42/16 |
| 4,058,922 | 11/1977 | Elbe et al. | 42/16 |
| 4,069,608 | 1/1978 | Jurek | 42/49 A |
| 4,098,016 | 7/1978 | Foote | 42/16 |

*Primary Examiner*—Charles T. Jordan
*Attorney, Agent, or Firm*—Jones, Thomas & Askew

[57] ABSTRACT

Apparatus for converting a firearm of a first caliber to fire cartridges of a second caliber. The regular bolt assembly of the firearm is removed and replaced with a conversion bolt assembly having a flat receiver plate which is bifurcated to provide a pair of flat rails. A bolt assembly is supported for movement along the rails, out of contact with the receiver of the firearm. The receiver plate of the conversion bolt assembly extends forwardly from a backplate which accurately locates the conversion assembly within the firearm, and the receiver plate is tilted to clear the conventional ejection port of the firearm. The conversion bolt assembly includes an automatic sear trip which enables full-automatic firing of second caliber cartridges on firearms that are so equipped, and also includes a weight for improved full-automatic operation. The disclosed embodiment is designed for use with an M-16 or AR-15 rifle.

16 Claims, 16 Drawing Figures 39a
80
39b
37
46
50
43
112
119
38
71
70
74a
73
74b
75
79
22a
24
22b
23a
23b
76
43
92
95
60
96
118
20a
55
101
21
20b
44
91
32a
104
113
89
103
17
32b
100
94
117
88
108a
109a
62
18
109b
108b
63
64
65
28
19

WEAPON CONVERSION APPARATUS

This invention relates in general to firearms and in particular to apparatus for converting a rifle to fire a cartridge other than the cartridge for which the rifle is chambered.

Rifles and other firearms are designed to fire cartridges of a particular caliber, as determined by two aspects of the firearm. One such aspect is the diameter of the barrel through which the projectile must pass. The other aspect is the configuration and size of the cartridge-receiving chamber within the firearm. Those skilled in the art know that a firearm which is chambered to receive a cartridge of a particular caliber cannot safely be fired with a cartridge of a different caliber, unless the firearm has been suitably modified.

It is frequently desirable to modify a rifle or other weapon of existing caliber so as to use subcaliber ammunition for various purposes. This need is particularly apparent in the case of firearms such as the M-16 rifle, which has become the standard U.S. infantry rifle and which is also widely used by other governmental agencies. Although the M-16 rifle is chambered for a 5.56 mm cartridge, the bore of the barrel will accept the slug of a conventional .22 long rifle rim fire cartridge. Since the cost of .22 ammunition is substantially less than that of the 5.56 mm cartridge, it would be much less expensive to use .22 ammunition while training recruits and others to shoot the M-16 rifle. Furthermore, it may be desirable in certain types of operations to utilize the relatively lower muzzle velocity of .22 ammunition while retaining the operational familiarity of the conventional M-16 rifle.

Subcaliber conversion devices have been proposed for use with various types of firearms, including the M-16 rifle. One example of apparatus for converting a M-16 (or its civilian counterpart, the AR-15 rifle) to fire standard .22 ammunition is shown in U.S. Pat. No. 3,776,095. While the conversion device of that patent is effective, the device is relatively expensive to manufacture and requires close attention to production tolerances. Other .22 conversion devices for the M-16 rifle have been designed and tested, but such devices suffer from various manufacturing and/or operational deficiencies which have prevented the general acceptance of any such conversion device.

Accordingly, it is an object of the present invention to provide an improved firearm subcaliber conversion apparatus.

It is another object of the present invention to provide improved apparatus for converting a firearm to utilize .22 rim fire ammunition.

It is still another object of the present invention to provide a .22 rim fire conversion apparatus for use with M-16 and AR-15 rifles.

Stated in general terms, the conversion apparatus of the present invention comprises a conversion bolt assembly which is substituted for the regular bolt assembly of a firearm such as the M-16 or AR-15 rifle. The conversion bolt assembly has a unitary flat receiver plate with a backing plate permanently affixed to one end thereof, and with the other end bifurcated by a slot to define a pair of longitudinally-extending parallel rails. The receiver plate may be laterally dimensioned to contact the interior of the upper receiver in an M-16 so as to positively locate the conversion bolt assembly apparatus therein.

A sliding bolt assembly is carried and guided by the two parallel rails to keep the bolt assembly out of sliding contact with the receiver of the rifle. The bolt assembly has slots for receiving the parallel rails of the receiver plate, and includes a self-contained recoil spring which urges the bolt forwardly. A barrel assembly is held in place between the open ends of the parallel rails, which are sufficiently resilient to be separated for assembly or disassembly of the conversion apparatus, and the barrel assembly includes an insert portion which fits within the chamber of the rifle to be converted.

An anti-bounce weight and an automatic sear trip are included with the present conversion apparatus, enabling full-automatic firing of .22 cartridges in a weapon such as the M-16 which is designed for full-automatic firing.

The nature of the present invention, as well as other objects and advantages thereof, will become more readily apparent from the following description of the disclosed preferred embodiment as shown in the drawings, in which.

Figures 1, 3A:
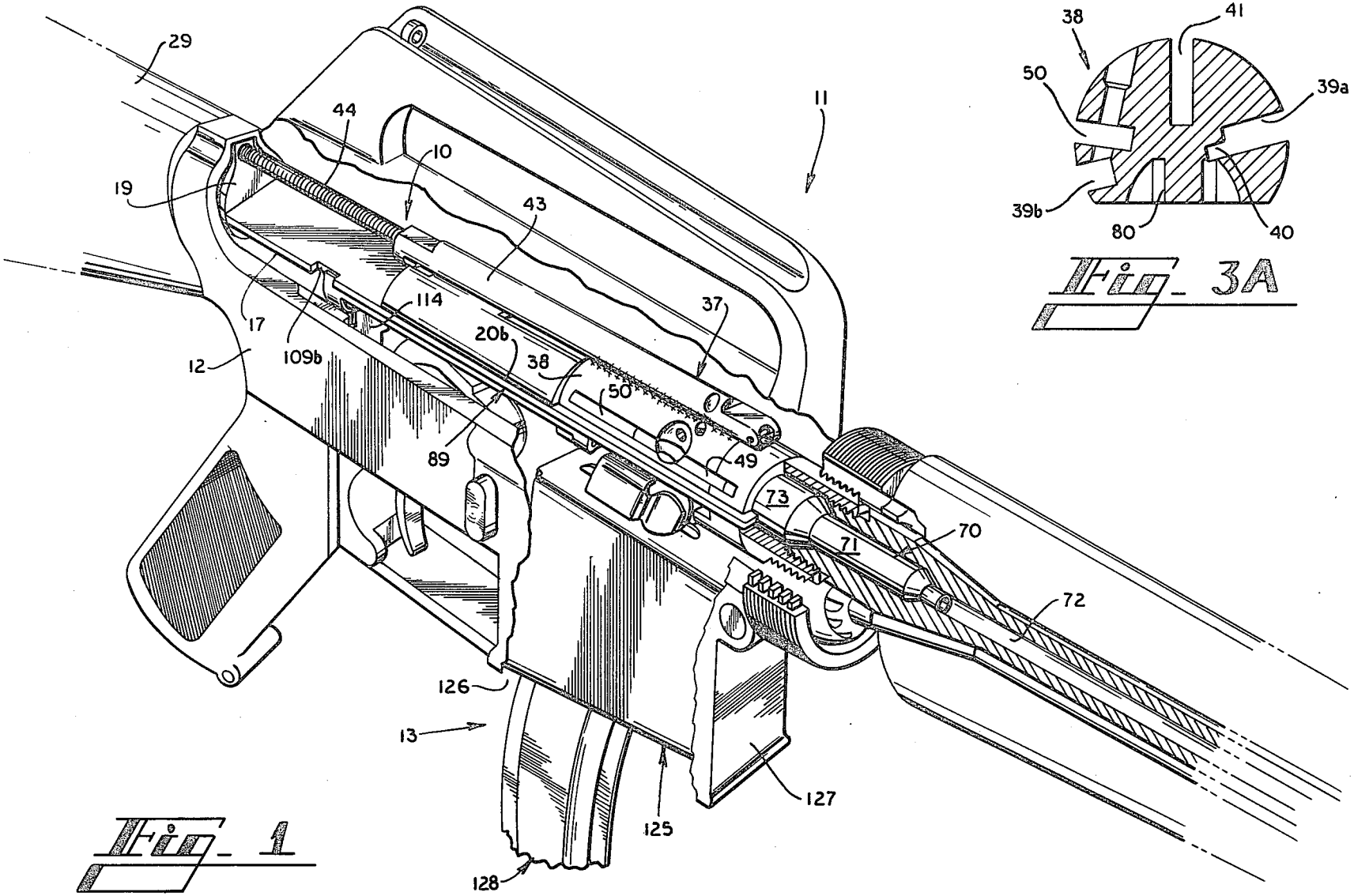
FIG. 1 shows a pictorial view of the disclosed embodiment of the present weapon conversion apparatus as installed in a M-16 rifle which is depicted fragmentarily partially and broken-away for clarity.
FIG. 3A is a sectioned elevation view of the bolt body used in the disclosed embodiment.

Turning to FIG. 1, there is shown generally at 10 a conversion bolt assembly apparatus according to the present invention, which is shown installed in a conventional M-16 rifle 11 in place of the regular bolt assembly with which that rifle is normally equipped. Many conventional details of the M-16 rifle are omitted from FIG. 1, since that rifle is depicted only to show the installation and operation of the present conversion apparatus. Also shown in FIG. 1 is the conversion magazine 13 which is substituted for the conventional 5.56 mm magazine normally used with the M-16.

Figure 2:
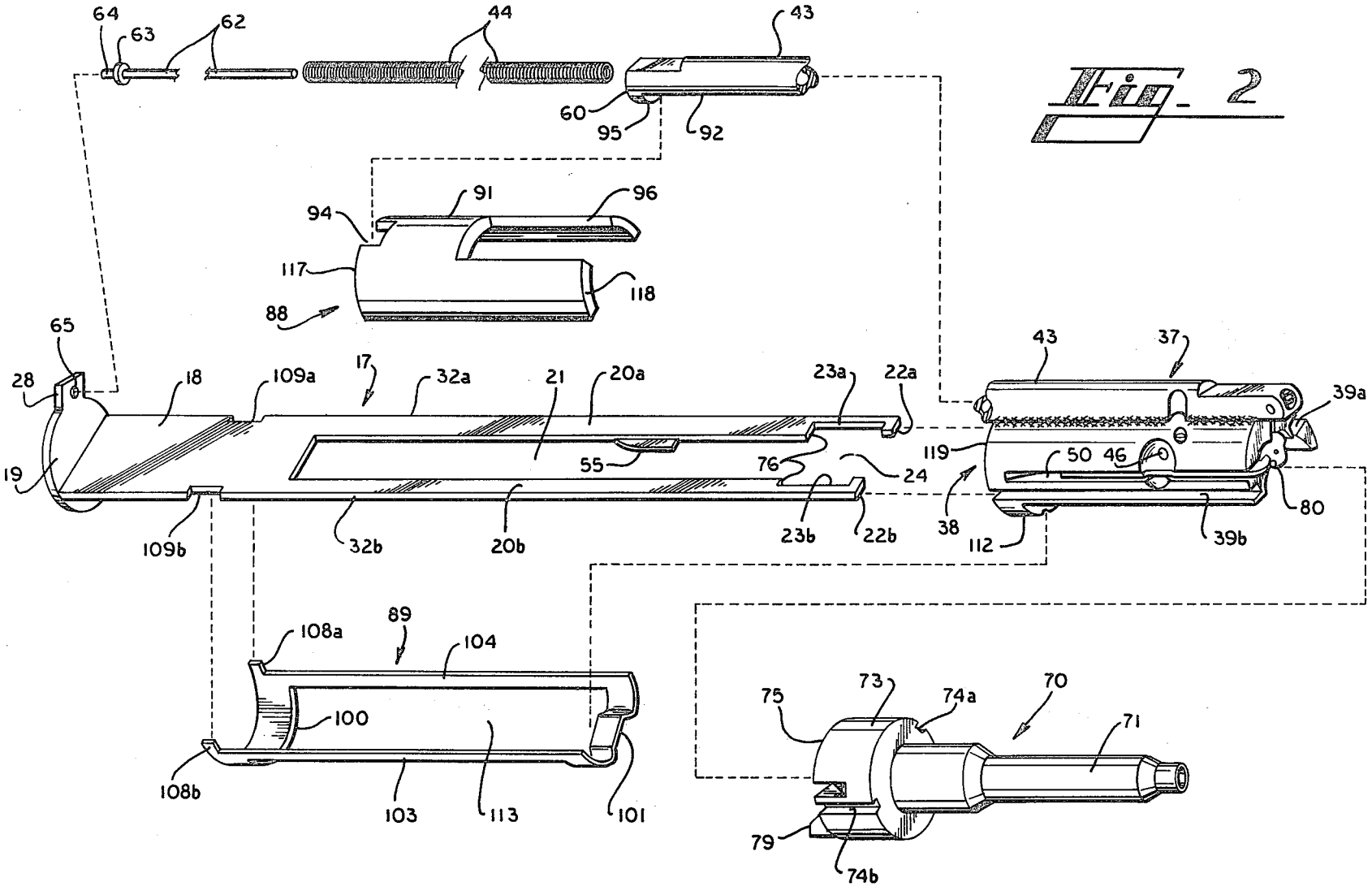
FIG. 2 shows an exploded view of the embodiment shown in FIG. 1.
Figure 4:
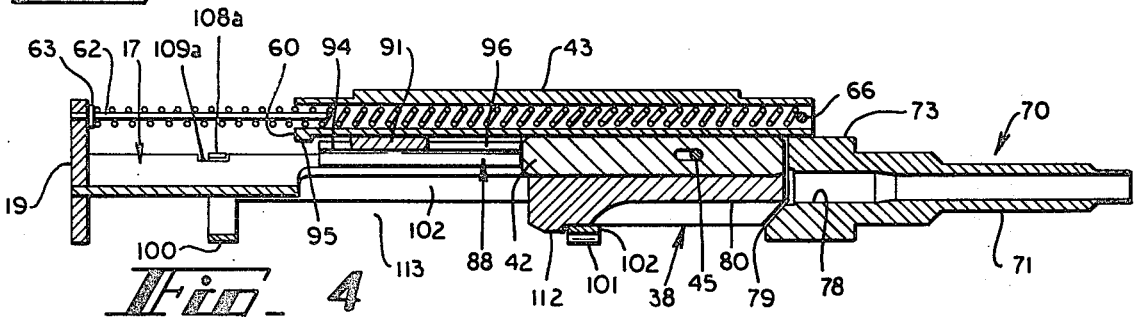
FIG. 4 is a side elevation section view taken along line 4—4 of FIG. 3, with the anti-bounce weight depicted in phantom for clarity.
Figure 5:
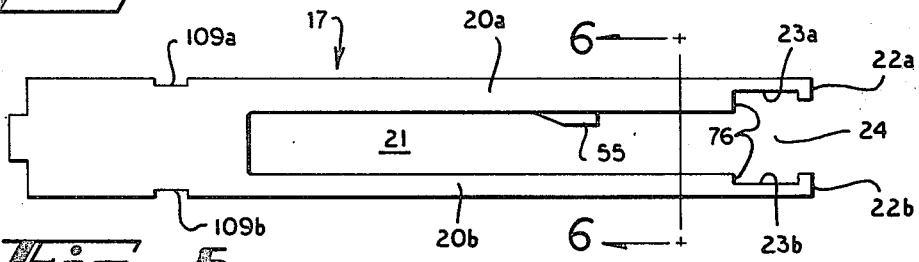
FIG. 5 is a plan view showing the receiver plate of the diclosed embodiment.
Figure 8:
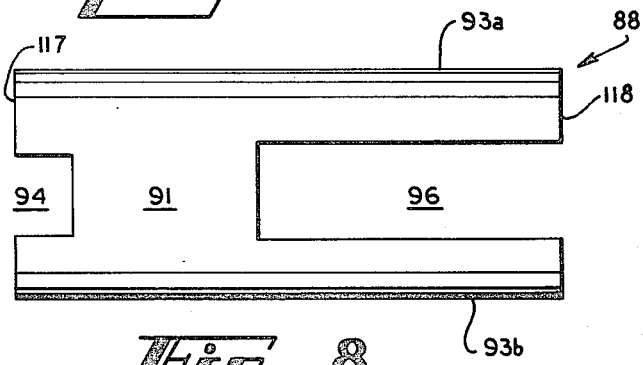
FIG. 8 is a top plan view showing the anti-bounce weight.
Figure 9:
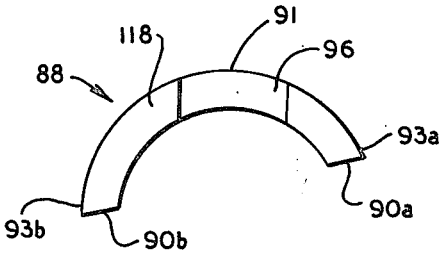
FIG. 9 is an elevation view of the anti-bounce weight, seen from the right side of FIG. 8.
Figure 10:
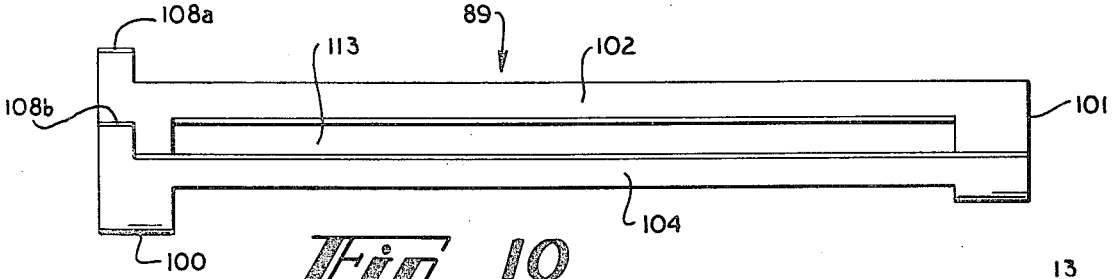
FIG. 10 is a side elevation view of the trip for the automatic sear.

The individual components which make up the conversion apparatus 10 are best seen in the exploded view of FIG. 2, and in the sectioned assembly view of FIG. 4. The conversion apparatus has a flat receiver plate 17 having a solid back portion 18 which is affixed to a backplate 19. The portion of the receiver plate 17 which extends forwardly from the back portion 18 is bifurcated to provide two flat parallel rails 20*a* and 20*b* which surround and define the longitudinally-extending slot 21. The rails 20*a* and 20*b* terminate at ends 22*a* and 22*b* which are remote from the backplate 19. Notches 23*a* and 23*b*, respectively, are formed in the rails 20*a* and 20*b* adjacent the ends 22*a*, 22*b* thereof, and the notches are mutually confronting so as to define the recess 24 for receiving the barrel assembly. As is apparent from FIG. 5, the lateral width of the rail 20*a* is somewhat greater than that of the rail 20*b*, so that the depth of the notch 23*a* is accordingly greater to laterally center the barrel-receiving recess 24 on the receiver plate 17.

The backplate 19 is generally circular except for an upstanding lug 28 which is configured to be received within an existing recess contained in the upper receiver 12 of the M-16 rifle. The backplate 19 is thus positioned immediately in front of the conventional M-16 buffer assembly (not shown) which remains in place within the stock 29 of the rifle. The buffer assembly thus serves only to maintain the entire conversion assembly 10 urged forwardly into the upper receiver of the rifle, as will become more apparent below.

Figure 3:
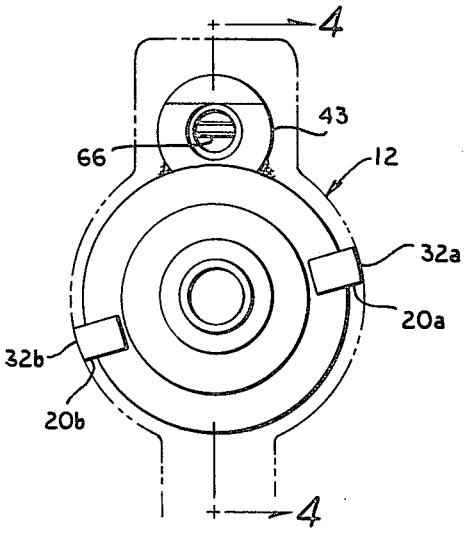
FIG. 3 shows an end elevation view of the disclosed embodiment, seen from the barrel end.
Figure 6:
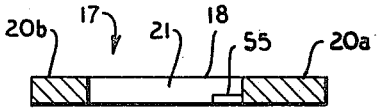
FIG. 6 is a section view taken along line 6—6 of FIG. 5, showing details of the ejector.

As best seen in FIGS. 1, 2, and 4, the forked receiver plate 17 is attached to the backplate 19 at an angle which is tilted from horizontal. This angular positioning of the receiver plate 17 causes the rail 20*b*, which extends along the right side of the upper receiver 12, to be placed lower than the left-side rail 20*a*, as particularly shown in FIG. 3. The right-side rail 20*b* is thus positioned below the ejection port (not shown) of the M-16 rifle, so that the rail cannot interfere with ejection of spent cartridges. The width of the receiver plate 17 is dimensioned so that the outer edges 32*a* and 32*b* of the receiver plate contact the confronting interior surface of the upper receiver 12, shown in phantom in FIG. 3, and the outer edges 32*a* and 32*b* may be optionally rounded as shown in FIG. 3 to conform with the contour of the receiver surface. The lateral position of the conversion apparatus 10 within the upper receiver 12 is thus assured with a sliding fit, and the aforementioned lug 28 on the backplate 19 provides the proper angular orientation of the conversion apparatus about the longitudinal axis of the rifle.

The conversion apparatus 10 further includes a sliding bolt assembly 37 which is supported for travel on the rails 20*a* and 20*b*. The bolt assembly 37 includes a bolt body 38 having a pair of longitudinally extending slots 39*a* and 39*b* which support the bolt assembly for travel on the two rails 20*a* and 20*b*. The diameter of the bolt body 38 is less than the lateral dimension across the rail edges 32*a* and 32*b*, as best seen in FIG. 3, so that the bolt assembly 37 is supported and guided by the rails to be out of contact with the upper receiver 12 as the bolt travels back and forth along the receiver plate 17. This manner of mounting the bolt assembly 37 provides a relatively low-friction travel to the bolt assembly, and assures that the upper receiver of the M-16 will not be contacted and damaged by travel of the conversion assembly bolt.

A firing pin 42, seen in FIG. 4, is received within a longitudinally-extending slot 41 (FIG. 3A) which is machined downwardly from the upper surface of the bolt body 38 and which is obscured from view in FIGS. 1 and 2 by the tubular housing 43 for the recoil spring 44. Longitudinal travel of the firing pin 42 within the bolt body 38 is controlled by the pin 45, which extends through a slot in the firing pin. The pin 45 is installed in the bolt body 38 through the opening 46, shown in FIG. 2.

Figure 7:
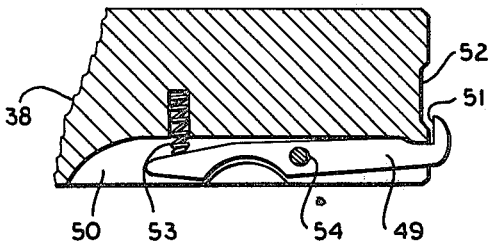
FIG. 7 is a partial section view of the bolt assembly, showing details of the extractor.

An extractor 49 is positioned within a slot 50 contained in the right side of the bolt body 38. The extractor 49 has a hooked end 51 which extends a short distance in front of the cartridge-receiving head 52 of the bolt body 38, as best seen in FIG. 7, and the spring 53 biases the extractor about the pivot 54 in the conventional manner.

The extractor 49 operates in conjunction with the ejector 55 which extends inwardly into the slot 21 from the left-side rail 20*a*. The ejector 55 is fixed and integral with the rail 20*a*, and may be formed by machining downwardly from the upper surface of that rail. The ejector 55 is slidably received in the ejector slot 40, which is formed as an extension of the slot 39*a* within the bolt body 38.

The previously-mentioned recoil spring housing 43 is welded to the top of the bolt body 38, and extends rearwardly to a back end 60 which is well behind the back of the bolt body 38. The spacing between the back end 60 of the spring housing 43 and the back plate 19 is chosen to define the maximum recoil travel of the bolt assembly 37. A spring guide rod 62 extends forwardly from the lug 28 of the backplate 19 and extends a distance into the spring housing 43 to provide guidance and support for the recoil spring 44. The guide rod 62 is formed with a bushing 63 adjacent its back end 64, and is removably fitted within the opening 65 in the lug 28. The force of the recoil spring 44, acting between the bushing 63 and the spring stop pin 66 or other impediment formed in the forward end of the spring housing 43, retains the spring guide rod 62 in assembly, yet permits ready removal of the rod and the spring during cleaning or other disassembly of the conversion assembly 10.

The conversion assembly 10 further includes a barrel assembly 70 which, in the disclosed embodiment, is a unitary item that is machined from a solid piece of steel. The barrel assembly 70 includes a short barrel member 71 having an exterior configuration which resembles the casing of a conventional 5.56 mm round, and which thus fits snugly within the chamber of an M-16 barrel 72 as shown in FIG. 1. The barrel assembly 70 further includes a main body portion 73 having a pair of slots 74*a* and 74*b* machined into opposite sides, with spacing such that the slots engage the notches 23*a* and 23*b* formed in the receiver plate side rails. The back face 75 of the barrel body 73 abuts against the forwardly-facing surfaces 76 which define the rear of the barrel recess 24 in the receiver plate 17, so that the barrel assembly 70 is maintained in the proper longitudinal position within the M-16 rifle, relative to the remainder of the conversion assembly 10, when the conversion assembly is inserted in the rifle. The barrel assembly 70 is positioned within the barrel recess 24 by resiliently spreading apart the rails 20*a* and 20*b* to position the body portion 73 within the barrel recess, and then releasing the rails; the notches 23*a* and 23*b* fit loosely within the corresponding slots 74*a* and 74*b* on the barrel body. The forward ends 22*a* and 22*b* of the rails 20*a* and 20*b* effectively form lugs which hold the barrel assembly in assembly on the receiver plate 17, when the entire conversion assembly 10 is removed from the rifle.

The interior of the barrel assembly 70 is chambered as at 78 in FIG. 4, to receive the subcaliber cartridge such as the conventional .22 long rifle rim fire cartridge. A feed ramp 79 is provided on the back face 75 of the barrel body 73, below the chamber 78. It is also seen in FIG. 4 that the underside of the bolt body 38 has a downwardly-extending spline 80 which functions in the conventional manner to strip the top round from the magazine and feed the round into the chamber 78, as the bolt travels forwardly during cocking or firing.

The disclosed embodiment 10 of conversion apparatus as described thus far is capable of converting either an M-16 or a AR-15 rifle to fire .22 caliber ammunition semiautomatically. The conversion is accomplished by removing the regular bolt assembly from the rifle and replacing with the conversion bolt assembly apparatus 10. The conventional buffer and recoil spring remains in the rifle, and the buffer abuts the backplate 19 to urge the entire conversion assembly 10 forwardly so that the barrel member 71 fits snugly within the chamber of the rifle. The forward end of the conventional M-16/AR-15 charging handle (not shown) projects downwardly in front of the forward end of the spring housing 43, so that the bolt assembly 37 can be moved backwardly by the charging handle to cock the hammer, and then moved forwardly by the recoil spring 44 to feed a round from the conversion magazine 13 into the chamber 78 of the barrel assembly 70. When the trigger of the rifle is pulled, the conventional rifle hammer strikes the firing pin 42 to fire the chambered round, the recoil from the round forces the bolt assembly 37 rearwardly to the maximum extent permitted by contact of the spring housing back end 60 with the backplate 19. The spent casing is extracted and ejected at this time, and the bolt assembly then moves forwardly to chamber a fresh round. The next round may be fired semiautomatically by again pulling the trigger of the rifle. The rifle is readily re-converted to fire conventional ammunition simply by replacing the conversion bolt assembly apparatus 10 with the regular bolt assembly, and inserting a conventional magazine. The conversion apparatus 10 is easily disassembled for cleaning simply by resiliently spreading apart the rails 20*a* and 20*b* sufficiently to remove the barrel assembly 70, after which the entire bolt assembly is removed by sliding off the open ends of the rails. The receiver plate 17 is preferably stamped from sheet metal such as cold rolled steel for ease and economy of manufacture, and to provide the resiliency necessary to spread apart the rails for assembly and disassembly.

The present conversion apparatus can be used to convert an M-16 for full-automatic fire of .22 caliber ammunition by adding the anti-bounce weight 88 and the automatic sear trip 89, both which are separate elements that fit in place about the conversion apparatus 10 without requiring modification or special installation. The anti-bounce weight 88 in the disclosed embodiment is an approximately hemi-cylindrical member which slides on the upper surface of the receiver plate 17 behind the bolt body 38 and beneath the spring housing 43. The weight 88 has a pair of lower coplanar surfaces 90*a* and 90*b* which slide along the receiver plate, and a radius 92 of a concave surface is provided in the underside of the spring housing 43 so that the top 91 of the weight has a sliding fit with the concave radius 92 of the spring housing. The lateral dimensions of the weight 88 are selected so that the longitudinal edges 93*a* and 93*b* of greatest width, running between the front and the back of the weight, are substantially the same width as the lateral dimension of the receiver plate 17. The weight 88 thus fits within the upper receiver 12 for lateral guidance while undergoing longitudinal sliding movement on the receiver plate.

The weight 88 has a first notch 94 at the back of the top 91, and this notch receives the lug 95 which extends downwardly from the back end 60 of the spring housing 43. The notch 94 provides a limited extent of lost-motion travel between the weight 88 and the bolt assembly 37 for a purpose described below. The weight 88 also has a forwardly-facing notch 96 which provide clearance to allow the hammer of the rifle to strike the firing pin 42.

Figure 11:
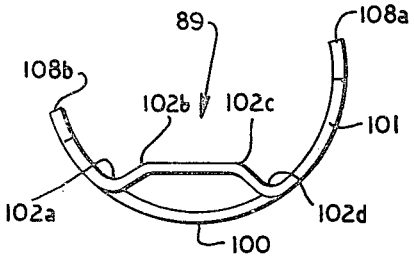
FIG. 11 is an end elevation view of the automatic sear trip, as seen from the right side of FIG. 10.

The automatic sear trip 89 is placed immediately below the receiver plate 17 of the conversion assembly, and is vertically supported by a mating surface (omitted in FIG. 1 for clarity) of the upper receiver 12. The trip 89, which can be fabricated from a single sheet-metal stamping, has a rear trip-engaging member 100 in the shape of a cylindrical hoop segment, and has a forward member 101 in the shape of a cylindrical hoop section having a flattened portion which extends upwardly above the radius of member 100, as best seen in FIGS. 2 and 11, so as to clear the existing bolt catch (not shown) of the M-16. The trip-engaging member 100 and the front member 101 are interconnected by a pair of longitudinally-extending strips 103 and 104. The total arcuate dimension of the front member 101, including the flattened portion 102 and the bends 102*a*, 102*b*, 102*c*, and 102*d*, is preferably the same as that of the trip-engaging member 100, so that the trip 89 can easily be formed by simple stamping and bending operations.

A pair of tabs 108*a* and 108*b* extend upwardly from the top of the trip-engaging member 100, and these tabs are received within mating slots 109*a* and 109*b* in the back portion 18 of the receiver plate 17. The slots 109*a* and 109*b* are longitudinally longer than the corresponding dimension of the tabs 108*a* and 108*b*, thereby providing an extent of lost-motion movement for the trip 89 relative to the receiver plate 17.

The position of the automatic sear trip 89 in assembly is best seen in FIGS. 2 and 4 where the front member 101 is located beneath the bolt body 38 immediately in front of a projection 112 which extends downwardly from the bolt body to lie immediately behind the front member of the trip, when the bolt assembly 37 is in full forward position. The trip 89 thus defines an internal slot or "window" 113 within which the bolt projection 112 is free to travel longitudinally, the longitudinal travel of the trip itself being limited by the lost-motion connection of slots 109*a*, 109*b*, and tabs 108*a*, 108*b*.

When the conversion assembly 10 with the anti-bounce weight 88 and the automatic sear trip 89 are installed in an M-16 as shown in FIG. 1, the trip-engaging member 100 is positioned immediately behind the conventional automatic sear 114 of the rifle. When the bolt assembly 37 is pulled back and then released by the charging handle (not shown) of the rifle, the hammer is cocked in the conventional manner and the top .22 round in the conversion magazine 13 is chambered in the conversion barrel assembly 70. Assuming that the selector lever of the M-16 is in position for full-automatic fire when the trigger is pulled and held, the recoil from the first round drives the bolt assembly backward in the manner described above. The automatic sear 114, under the force of its conventional spring, presses against the trip-engaging member 100 to slide the entire trip 89 backwardly at this time, to the maximum extent permitted by tabs 108 and slots 109. A fresh round is chambered as the recoil spring 44 moves the bolt assembly forwardly, and the projection 112 moves forwardly through the window 113 in the trip 89 to contact the front member 101 slightly before the forwardmost travel of the bolt assembly. The trip 89 is thus moved forwardly by the final forward travel of the bolt assembly, causing the trip-engaging member 100 to contact the automatic sear 114 and release the hammer. The newly-chambered round is fired, and the full-automatic firing cycle repeats until the trigger is released or the magazine is emptied.

The disclosed design and construction of the automatic sear trip 89 allows the trip to have a sufficiently low mass so that the trip is reliably moved backwardly by the force of the standard automatic sear spring each time the rifle fires, an important consideration if reliable full-automatic fire of the subcaliber cartridges is to be obtained without replacing the conventional automatic-trip spring of the rifle. An added benefit of the cylindrical hoop shape of the trip-engaging member 100 is that such shape resists damage if it is attempted to close the rifle, immediately after installing the conversion bolt assembly 10, with the firing selector in full-automatic position. The automatic sear of the rifle is in interference with the member 100 under such conditions, and the strength of the hoop configuration prevents the member from being deformed or otherwise damaged by an improper attempt to close the rifle.

The operation of the anti-bounce weight 88 during full-automatic fire is now considered. Assuming that a round has just been fired, the weight 88 is pushed backwardly along the receiver plate 17 by the bolt body 38. Since the back end 60 of the spring housing 43 extends rearwardly beyond the back end 117 of the weight 88, the lost-motion connection provided by the notch 94 and the lug 95 permits the weight to continue its backward sliding travel after backward travel of the bolt assembly is arrested by contact of the back end 60 with the back plate 19. As the recoil spring 44 commences to move the bolt assembly 47 forwardly, the lug 95 moves forwardly in the notch 94 of the backwardly-traveling weight 88 to contact the weight, so that the rearward momentum of the weight reduces the developing forward momentum of the bolt assembly. This contact with the bolt slows the cyclic firing rate of the weapon conversion apparatus and also reduces possible surging or uneven rates of fire, both of which results are desirable.

The weight 88 is now pulled forwardly by the lug 95 until the bolt body 38 contacts the body 73 of the barrel assembly 70. Since neither the bolt body 38 nor the barrel body 73 are inelastic members, there is a tendency for the bolt assembly to bounce back a short distance immediately after contacting the barrel assembly, and that bounce-back would partially unchamber the round while the hammer was striking the firing pin, leading to a misfire and possible jamming of the rifle. Forward sliding travel of the anti-bounce weight 88 continues for a brief interval after forward travel of the bolt assembly is arrested, however, and the forward end 118 of the weight strikes the back end 119 of the bolt body 38 with sufficient momentum to prevent incipient bounce-back of the bolt assembly. The weight 88 thus eliminates or reduces bolt bounce during full-automatic fire, as well as reducing and controlling the cyclic rate of fire with the present conversion appratus.

The conversion magazine 13, as best seen in FIGS. 12–15, includes a magazine housing 125 which fits within the magazine well 126 of the M-16 lower receiver 127, and a cartridge magazine 128 which is supported by the magazine housing in proper cartridge feeding relation with the bolt body 38 and the barrel assemble 70. The magazine housing 125 is preferably fabricated from a single flat piece of sheet metal 129 which is bent as at **130*a* and 130*b* to provide upper corners which define the top surface 131 of the magazine housing and is additionally bent as at 132*a* and 132*b*, providing overlapping bottom portions 133 and 134 which have confronting cut-outs, FIG. 15, to form the opening 135 for receiving the magazine 128. A similar magazine-receiving opening is formed in the top surface 131 by stamping, and slots are also provided in the top and bottom of the magazine housing to receive the alignment fins 139*a* and 139*b* of the magazine 128. The magazine 128 is secured to the magazine housing 125** by welding at the locations where the magazine aligning fins pass through the alignment slots in the top and bottom surfaces of the magazine housing.

Figure 12:
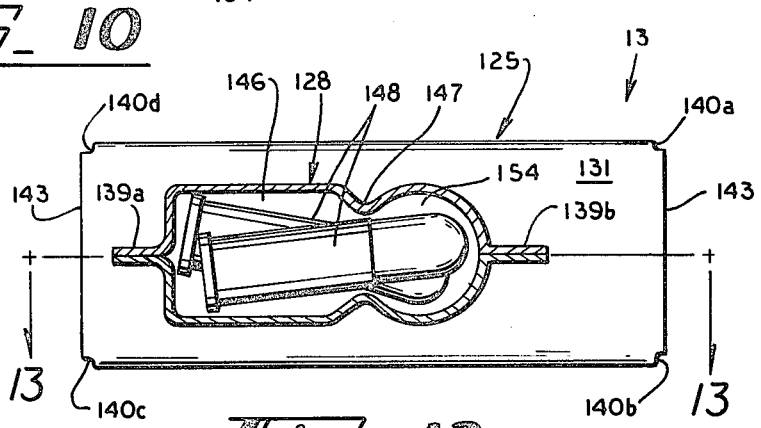
FIG. 12 is a top section view of a magazine for use with the disclosed embodiment of the present invention.
Figure 13:
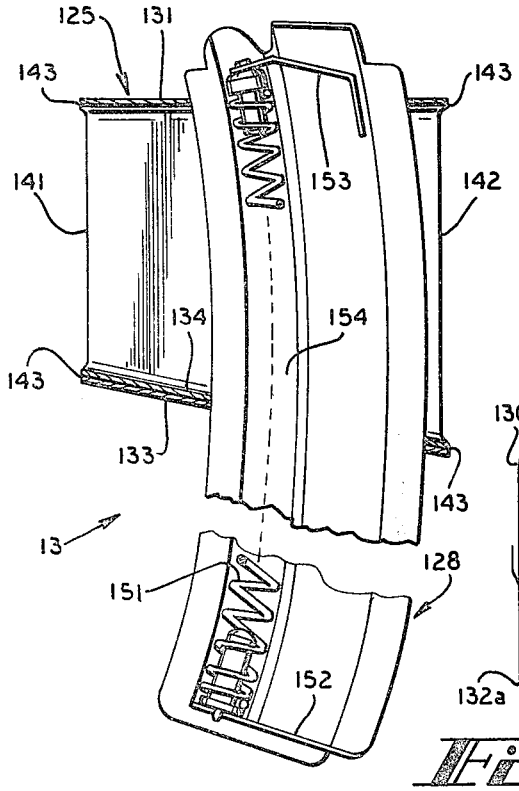
FIG. 13 is a vertical section view taken along line 13—13 of FIG. 12, with cartridges omitted for clarity.
Figure 15:
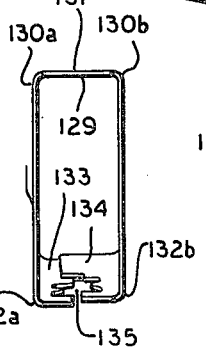
FIG. 15 is a rear elevation view of the housing for the magazine shown in FIG. 12, less the magazine.
Figure 14:
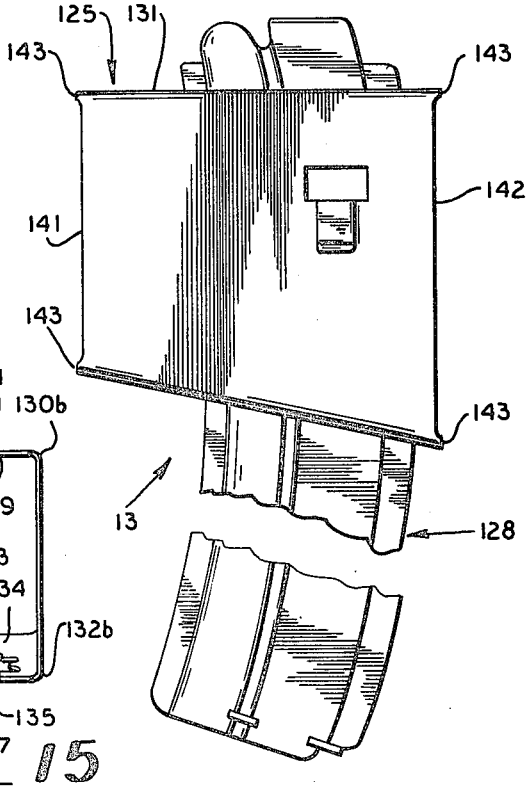
FIG. 14 is a left elevation view of the magazine shown in FIG. 12.

The magazine well of the M-16 rifle has radiuses on each corner, and so it is necessary to provide the magazine housing 125 with cut-away corners **140*a*–140*d*, FIG. 12, to accommodate the radiuses within the magazine well. The cut-away corners are conveniently obtained in the one-piece stamped magazine housing by stamping out a relief portion in the front magazine housing edges, collectively indicated at 141, and in the back edges collectively indicated at 142, as best seen in FIGS. 13 and 14. The top surface 131 and the bottom surface of the magazine housing are thus provided with flat projecting surfaces, collectively designated 143, which contact the front and back wall of the magazine well 126 so as to locate the conversion magazine 13 therein. The relief portions are readily provided by stamping in the flat sheet metal 129 which is bent to form the magazine housing 125**.

A back portion 146 of the magazine 128 is sufficiently wide to receive .22 caliber cartridges in side-by-side staggered configuration, and a forward region of the magazine is necked inwardly at 147 to laterally locate the staggered cartridges 148 within the magazine. The magazine is curved forwardly as shown in FIGS. 13 and 14, to accommodate a relatively long magazine spring 151 extending between the floor plate 152 and the cartridge follower assembly 153. The forwardmost part of the magazine 128 is curved to define a generally tubular spring guide channel 154 which contains the coiled magazine spring 151. The disclosed magazine arrangement with side-by-side loading and a forwardly-curved magazine allows magazines of at least thirty rounds capacity of .22 caliber ammunition to be accommodated with accurate cartridge feeding in full-automatic fire, while allowing the force of the magazine spring 151 to be sufficiently low to permit hand-loading of the magazine. Of course, magazines of suitable other cartridge capacities can also be fabricated according to the present teachings.

Summarizing the foregoing disclosure, there is shown a conversion bolt assembly apparatus which can be manufactured with relatively little precision machining, apart from the bolt body and the barrel assembly, and yet which accurately defines bolt travel without moving contact with the upper receiver of the rifle. A relatively heavy anti-bounce weight and a relatively light automatic sear trip can be provided for full-automatic operation without otherwise modifying the basic conversion assembly as used for semi-automatic operation. The use of stamped sheet-metal components, both in the conversion assembly and in the conversion magazine, provides a conversion appartus that can be inexpensively mass-produced for reliable operation.

It will be understood that the foregoing relates only to a disclosed preferred embodiment of the present invention, and that numerous alterations and modifications may be made therein without departing from the spirit and the scope of the invention as defined in the following claims.

What is claimed is:

1. Conversion bolt assembly apparatus for converting a firearm, having a receiver, a regular bolt assembly, a side ejection port, and a chamber which is chambered for cartridges of a first caliber, to fire cartridges of a second caliber by replacing the regular bolt assembly of the firearm, comprising, a backplate having means which engages a portion of the firearm so as to orient said backplate in predetermined relation to the receiver of the firearm;

a receiver plate attached to and extending forwardly from said backplate and including a pair of spaced apart parallel rails which terminate at remote ends a distance from said backplate;

a barrel assembly carried by said unsupported ends of said rails;

said barrel assembly having means which is externally configured to fit in the chamber of the firearm and having a cartridge receiving chamber to receive a cartridge of said second caliber;

a bolt guided by said rails for reciprocal movement between a forward position at said chamber of said barrel assembly and a rearward position;

extractor means carried by said bolt and operative to withdraw a cartridge from said cartridge receiving chamber of said barrel assembly; and said rails being in a plane which is tilted relative to horizontal as said conversion bolt assembly is oriented within the firearm, so that the side ejection port of the firearm is not obstructed by said receiver plate.

2. Apparatus as in claim 1, wherein:

each of said rails has a recess facing the other said rail adjacent said remote ends, so that said recesses provide a region for receiving said barrel assembly between said rails;

said barrel assembly has a pair of slots positioned to receive said rails as said barrel assembly is located within said region; and said rails have a projection which extends in front of said region to retain said barrel assembly in said region.

3. Apparatus as in claim 1, wherein:

said receiver plate has a first solid portion which is connected to said backplate and which extends a distance forwardly therefrom, and a bifurcated portion which extends forwardly from said solid portion to define said pair of spaced apart rails;

means extending rearwardly from said bolt to terminate a predetermined distance in front of said backplate, so that said predetermined distance defines the maximum rearward travel of said bolt while said bolt remains supported between said bifurcated portion, so that reciprocation of said bolt occurs substantially along said bifurcated portion and thus does not compress air within said firearm receiver which would otherwise impede bolt operation.

4. Conversion bolt assembly apparatus for converting a firearm having a receiver, a regular bolt assembly, and a chamber which is chambered for cartridges of a first caliber to fire cartridges of a second caliber by substituting for the regular bolt assembly of the firearm, comprising:

a unitary receiver plate having a solid back portion and having a pair of spaced apart parallel rails extending forwardly from said back portion to terminate at ends remote from said back portion;

said receiver plate having a lateral exterior dimension selected to permit said receiver plate to contact the interior of the receiver of the firearm, when said conversion bolt assembly is disposed therein, so as to define the lateral location of said conversion bolt assembly therein;

bolt means disposed between said spaced apart rails, said bolt means being supported and located by said rails for longitudinal travel along said rails;

said bolt means being located by said rails so as to be out of sliding contact with said firearm receiver as said bolt means undergoes longitudinal travel;

locating means disposed on said back portion of said receiver plate in position to engage said firearm so as to provide a predetermined certain orientation of said conversion apparatus in the firearm, and barrel means received between said spaced apart rails in the vicinity of said remote ends, said barrel means having a first portion which is externally configured to fit the chamber of said firearm and having a second portion which is chambered to receive a cartridge of said second caliber.

5. Apparatus as in claim 4, wherein:

said barrel means has a pair of longitudinally-extending slots that are configured and located to receive mating portions of said rails as said barrel means is received in predetermined location between said rails; and at least one of said rails having an abutment which contacts the back of said barrel means to provide rearward longitudinal location of said barrel means.

6. Apparatus as in claim 5, further comprising:

means located at said remote ends of said rails to extend in front of said barrel means so as to retain said barrel means in place between said rails; and wherein said rails are sufficiently resilient to be resiliently spread apart at said remote ends for removing said barrel means from said location between said rails.

7. Apparatus as in claim 4, wherein:

said locating means disposed on said back portion of said receiver plate comprises a backplate including a plate portion extending upwardly from said back portion; said further comprising a first member carried by said bolt means and having a back end facing said plate portion in predetermined spaced apart relation thereto;

a second member extending forwardly from said plate portion in telescopic relation with said first member; and a recoil spring operatively interposed between said first and second members to urge said first member and said bolt means forwardly along said rails to meet said barrel means.

8. Apparatus as in claim 7, wherein:

one of said first and second members comprises a hollow tube and the other of said means comprises a rod that is slidably received within said tube; and said recoil spring is disposed on said rod and is at least partially received within said tube.

9. Apparatus as in claim 4, further comprising:

a bolt anti-bounce weight slidably disposed on said receiver plate between said bolt means and said means disposed on said back portion of said receiver plate;

said weight having a forward surface for contacting a mating surface on the back of said bolt means; and means operatively associated with said bolt means to move said weight on said receiver plate with a lost-motion action in relation to said bolt means as said bolt means travels on said rails, so that said forward surface of said weight strikes said mating surface of said bolt means a short time after said bolt means reaches its forwardmost extent of travel on said rails.

10. Apparatus as in claim 9, wherein:

said weight rests on said receiver plate for longitudinal sliding movement; and said weight has a lateral exterior configuration for sliding contact with said interior of the firearm receiver as said weight is reciprocated on said receiver plate by the longitudinal travel of said bolt means.

11. Apparatus as in claim 9, wherein:

said bolt means carries a firing pin;

the space between said parallel rails extends behind said bolt means when in the forwardmost position of travel, so as to allow the hammer of the firearm to pass between said rails to contact said firing pin; and said weight has a cut-out portion which is aligned with said hammer travel space between said rails to allow said hammer to contact said firing pin without interference from said weight.

12. Apparatus as in claim 9, further comprising:

stop means operatively associated with said bolt means and extending rearwardly to terminate at a predetermined distance from said locating means on said back portion of said receiver plate, so that said certain distance defines the travel of said bolt means;

said stop means being spaced apart from said receiver plate and said weight being located in the space between said stop means and said receiver plate; and said lost-motion action being provided betweem said weight and said stop means, so that said lost-motion action enables said rearwardly-traveling weight to be contacted by the forwardly-moving bolt means a short time after said stop means contacts locating means to arrest backward travel of the bolt means.

13. Apparatus as in claim 4, for use in a firearm which is equipped with an automatic sear to be tripped by movement of the regular bolt assembly for full-automatic fire of said first caliber cartridge, further comprising;

trip means located on the lower side of said receiver plate for a limited extent of longitudinal travel relative to said automatic sear;

said trip means having a first portion which is engageable by the forwardmost travel of said bolt means to move the trip means; and said trip means having a second portion which engages and operates said automatic sear in response to said engagement of said first portion by said bolt means.

14. Apparatus as in claim 13, wherein:

said trip means is configured to be supported by the firearm receiver immediately below said receiver plate for said limited extent of longitudinal movement; and lost-motion means operatively interconnecting said trip means and said receiver plate to allow said trip means to travel forwardly in response to said engagement of said first portion by said bolt means, and to allow said trip means to be urged backwardly by said automatic sear when said bolt means recoils from said first portion.

15. Apparatus as in claim 14, wherein:

said second portion of said trip means comprises a first annular member having locating tab means which extends upwardly into mating slot means formed in said receiver plate, said locating tab means and slot means comprising said lost-motion means;

said first annular member extending downwardly for engagement with said automatic sear; and said first portion of said trip means comprises a second annular member disposed to engage said bolt means.

16. Apparatus as in claim 15, wherein:

said trip means comprises a sheet metal stamping in which said first annular member comprises a first hoop segment having a certain circumferential extent; and said second annular member comprises a second hoop segment which also has said certain circumferential extent; and linking means unitary with and interconnecting said first and second hoop segments.

* * * * *